US007201642B2

(12) United States Patent
Koh et al.

(10) Patent No.: US 7,201,642 B2
(45) Date of Patent: Apr. 10, 2007

(54) PROCESS FOR PRODUCING IMPROVED MEMBRANES

(75) Inventors: Meng Fei Koh, Singapore (SG); Choon Siong Poh, Singapore (SG); Inn Swee Goh, Singapore (SG); Theng Wei Leong, Singapore (SG); Teck Leong Neo, Singapore (SG); Bing Wang, Singapore (SG)

(73) Assignee: Systems on Silicon Manufacturing Co. Pte. Ltd., Singapore (SG)

( * ) Notice: Subject to any disclaimer, the term of this patent is extended or adjusted under 35 U.S.C. 154(b) by 0 days.

(21) Appl. No.: 10/544,010

(22) PCT Filed: Jun. 14, 2004

(86) PCT No.: PCT/SG2004/000183

§ 371 (c)(1),
(2), (4) Date: Aug. 1, 2005

(87) PCT Pub. No.: WO2005/123342

PCT Pub. Date: Dec. 29, 2005

(65) Prior Publication Data

US 2006/0258273 A1 Nov. 16, 2006

(51) Int. Cl.
*B24B 1/00* (2006.01)

(52) U.S. Cl. ..... 451/53; 451/7

(58) Field of Classification Search ..... 451/7, 451/53, 285–289, 388, 397, 398
See application file for complete search history.

(56) References Cited

U.S. PATENT DOCUMENTS

| | | | | |
|---|---|---|---|---|
| 6,077,151 | A * | 6/2000 | Black et al. | 451/53 |
| 6,080,050 | A | 6/2000 | Chen et al. | |
| 6,183,354 | B1 | 2/2001 | Zuniga et al. | |
| 6,506,104 | B2 | 1/2003 | Perlov et al. | |
| 6,540,594 | B2 | 4/2003 | Zuniga et al. | |
| 6,602,114 | B1 * | 8/2003 | Wang et al. | 451/41 |
| 6,705,923 | B2 * | 3/2004 | Liu et al. | 451/7 |
| 6,705,924 | B2 * | 3/2004 | Somekh | 451/9 |

FOREIGN PATENT DOCUMENTS

| | | |
|---|---|---|
| JP | 2003 142438 A | 5/2003 |
| JP | 2003 297784 A | 10/2003 |

* cited by examiner

*Primary Examiner*—Dung Van Nguyen
(74) *Attorney, Agent, or Firm*—Harness, Dickey & Pierce, P.L.C.

(57) ABSTRACT

The present invention relates generally to the field of chemical/mechanical polishing of substrates. In particular the invention relates to methods of producing improved membranes for use in chemical/mechanical polishing systems. The present invention provides a method of improving the properties of a flexible membrane for use in chemical/mechanical polishing, the method including subjecting the membrane to elevated temperatures.

13 Claims, 3 Drawing Sheets

PROCESS FOR PRODUCING IMPROVED MEMBRANES

FIELD OF THE INVENTION

The present invention relates generally to the field of chemical/mechanical polishing of substrates. In particular the invention relates to methods of producing improved membranes for use in chemical/mechanical polishing systems.

BACKGROUND OF THE INVENTION

With the rapid development of the electronics industry in recent years there has been phenomenal growth in the need for integrated circuits. As such there has been a significant focus world-wide on improving methods of manufacture of integrated circuits with a view to increasing production speed/efficiency. In general integrated circuits may be formed on a number of materials but they are typically formed on silicon wafers. The process of manufacture of integrated circuits of this type typically involves the sequential deposition of a number of layers of conductive, semiconductive or insulating layers onto the outer surface of a wafer. Using the process a number of layers are built up sequentially with each deposited layer becoming the new outer surface of the wafer. The wafer thus formed is typically etched after each layer is deposited so as to form the desired final circuitry features of the integrated circuit onto the wafer. As successive etched layers are built up the final form of the integrated circuit is produced.

One problem that potentially occurs in this process is that as the sequential layers are deposited and etched in this way, the outer surface becomes increasingly non-planar. This in turn causes difficulty as if the outer surface is non-planar then, as a consequence, any further layers placed on the outer layer will also be non-planar. As this reduces the performance of the final integrated circuit a number of approaches have been developed in order to produce planar surfaces as the successive layers are set down.

Chemical/mechanical polishing (CMP) is one of the preferred methods of planarization of substrate surfaces which has been used to alleviate this problem and which has found use in the manufacture of integrated circuits. This method typically requires mounting the substrate (such as the wafer) onto a carrier or polishing head in some way. The exposed surface of the substrate is then placed against a rotating polishing pad which removes excess material from the uneven topography on the surface of the substrate until a substantially flat (planar) surface has been created. The carrier head typically is configured to provide a controllable load pressure onto the substrate to press it evenly against the polishing pad to ensure even polishing across the surface of the substrate. A number of different carrier heads and/or polishing systems have been developed for use in chemical/mechanical polishing processes of this type.

A problem identified in the development of the carrier heads of this type has been the need to design a head that does not damage sensitive substrates such as the silicon wafers during handling. Silicon wafers that are subjected to the process are generally very thin and hence are not ideally suited to being brought into contact with any hard surfaces during movement operations. In addition, even if the surface of the head can be padded in some way there is the risk that the point of contact with the wafer may cause the surface of the wafer to become marked. In order to overcome these difficulties a number of techniques have been used. One technique that has found general application has been the use of flexible membranes that contact the substrate (wafer). In use these are actuated by creating a vacuum behind the membrane forming "suction cups" that contact the wafer and provide a "chucking" effect such that the wafer is held on the membrane. This has been found to effectively hold the wafers so that they can be moved by the head without causing the problems discussed above. In addition by pressurising a chamber behind the membrane, the membrane can force the wafer onto a polishing pad and assist in the polishing process. Accordingly there are a large number of carrier heads that contain flexible membranes in one configuration or another.

For example one suitable carrier head of this type is described in U.S. Pat. No. 6,080,050. This describes a carrier head including a flexible membrane and a compliant backing member for a chemical/mechanical polishing apparatus. The carrier head includes a flexible membrane, the lower surface of which provides a substrate receiving surface. The carrier head includes a compliant backing member with a plurality of cells which contact an upper surface of the flexible membrane to improve vacuum chucking of the substrate onto the head.

In another system, described in U.S. Pat. No. 6,183,354 there is described a carrier head for a chemical/mechanical polishing apparatus which includes a flexible membrane. The carrier head comprises a base, a support structure connected to the base by a flexure, and a flexible membrane connected to the support structure. The flexible membrane has a mounting surface for a substrate and extends beneath the support structure to define a chamber. The chamber may either be evacuated to form suction cups that grip the wafer when it is being moved or be pressurized in order to force the wafer onto the polishing surface during the polishing operation.

In yet another patent, namely U.S. Pat. No. 6,540,594 there is described a carrier head for a chemical/mechanical polishing apparatus comprising a base, a flexible membrane, and a retaining ring surrounding the central portion of the flexible membrane. The flexible membrane has a central portion with a mounting surface for a substrate and a perimeter portion connected to the base, the membrane extending beneath the base to define a chamber. The apparatus also includes a retaining ring surrounding the centre portion of the flexible membrane so as to hold the substrate in position especially when the membrane is pressurized.

Another carrier head that includes a flexible membrane is described in U.S. Pat. No. 6,506,104. This patent describes a carrier head with a flexible member connected to a base to define a first chamber, a second chamber and a third chamber. A lower surface of the flexible member provides a substrate receiving surface with an inner portion associated with the first chamber, a substantially annular middle portion surrounding the inner portion and associated with the second chamber, and a substantially annular portion surrounding the middle portion and associated with the third chamber. The use of a plurality of chambers allows for differential pressure to be applied by the head to different portions of the membrane and hence to the wafer.

As can be seen, there are a number of carrier heads that have been developed which all include flexible membranes in their construction. Indeed the carrier heads described above represent a mere subset of the number of heads that have been described which incorporate a flexible membrane.

One problem typically encountered with the use of a flexible membranes in carrier heads of these types is membrane failure whilst in use. The failure of the membrane cannot be accurately predicted by conventional test procedures which do not damage the membrane. Accordingly it is not possible to test individual membranes prior to use and as such membrane failure typically occurs when in use. With existing membranes the failure rate is approximately 3.5 failures per 10,000 wafer moves. This leads to significant downtime consequences as membrane failure typically leads to the wafer being dropped in the chemical/mechanical polishing apparatus. Whenever this happens it is necessary to rebuild the heads including application of a new membrane, replacement of any damaged tool parts and consumables and recovery of dropped wafers. Due to the high cleanliness required there is also the risk that there may be contamination of the apparatus by any broken pieces of wafer that have occurred due to wafer damage upon falling. Typically, it is found that whenever a wafer drop occurs it takes something of the order of 2 hours to rebuild the head and 4–6 hours to place the apparatus back in full manufacturing mode. As will be appreciated, this leads to significant machine downtime and reduction in the overall sufficiency of the manufacturing process. Accordingly there is a need to develop improved membranes for use in apparatus of this type in order to reduce this downtime. Any reduction in the incidence of membrane failure will directly lead to improved manufacturing efficiencies for machines of this type.

In order to attempt to overcome this problem the current applicants studied membranes and membrane properties at some length in relation to the conditions under which these membranes were forced to operate. It was found that the poor membrane performance typically occurred due to poor selection of physical properties of the membranes used in that the membranes used did not have physical properties that were compatible with the conditions they were required to operate under. Accordingly, there was an unacceptably high rate of failure of the existing membranes during use.

As a result of their studies the applicants have found that functional ability of the membrane was affected by a number of interacting physical parameters. Without wishing to be bound by theory it is felt that insufficient membrane performance is observed when one or more of the membrane's physical properties is not within the required bounds. Unfortunately, the ability to test these physical parameters relies on destructive means and, as such, it is not possible to accurately predict the performance of an individual membrane prior to use by testing its physical parameters.

SUMMARY OF THE INVENTION

The applicants of the present application were able to ascertain that significantly improved membrane performance in carrier heads could be achieved by treating the membranes either during membrane manufacture or as a step prior to using the membrane. In particular the applicants found that subjecting the current membranes to elevated temperatures improved the performance characteristics of the membranes.

The applicants have been successful in identifying process conditions that may be applied to existing membranes so that they have improved performance relative to untreated membranes. This allows existing membranes that can be purchased commercially to be converted into membranes with improved performance.

In one aspect the present invention provides a method of improving the performance of a flexible membrane for use in a chemical mechanical polishing system, the method including subjecting the flexible membrane to elevated temperatures.

The flexible membrane can be made of any suitable material typically used in membranes for chemical/mechanical polishing however the preferred membrane includes silicone rubber.

The flexible membrane may be of any suitable size for use in a chemical mechanical polishing system and the physical dimensions will typically be determined from the size of the carrier head. Nevertheless the membranes subjected to the process typically have a thickness of from 0.2 to 1.4 mm, more preferably from 0.6 to 1.0 mm, most preferably about 0.8 mm.

The flexible membrane may be subjected to the elevated temperature for a wide range of time periods with the time period being determined by the elevated temperature. The period of time may be any period that achieves the desired result however it is preferred that the period is no more than 24 hours, although longer treatment times have been found to work. The treatment period is typically from 5 minutes to 24 hours, more preferably from 5 minutes to 240 minutes, even more preferably from 10 minutes to 180 minutes, yet even more preferably from 20 minutes to 120 minutes, most preferably from 30 minutes to 90 minutes. The elevated temperature of the treatment is typically from 50° C. to 150° C., more preferably from 50° C. to 100° C., even more preferably from 60° C. to 95° C., most preferably from 75° C. to 90° C.

As will be readily appreciated there is a relationship between the duration of the treatment period and the temperature of the treatment. Typically it is found that the higher the temperature the shorter treatment time required. It is preferred that the treatment involves subjecting the flexible membrane to a temperature of from 50° C. to 100° C. for a period of from 15 minutes to 120 minutes. It is even more preferred that the flexible membrane is subjected to a temperature of from 60° C. to 95° C. for a period of from 30 minutes to 90 minutes. In a most preferred embodiment the membrane is subjected to a temperature of from 75° C. to 90° C. for a period of from 30 minutes to 90 minutes, most preferably from 60 minutes to 90 minutes. A number of specific regimes within these ranges are particularly preferred. One preferred regime is 90° C. for 60 minutes. Another preferred regime is 80° C. for 60 minutes. A further preferred regime is 75° C. for 120 minutes.

The membranes subjected to the process may be of any suitable type. Particularly preferred membranes include silicone rubber, preferably high strength silicone rubber.

It has been found that by using membranes that have been subjected to a process of this type membrane failure during the chemical/mechanical polishing of wafers is significantly lowered. This in turn leads to significantly reduced machine downtime as the heads have to be rebuilt far less frequently and the number of dropped wafers is also significantly reduced. This therefore leads to considerably higher manufacturing efficiency.

As stated previously the membranes that have been subjected to the process may be used in any carrier head for chemical/mechanical polishing that includes a flexible membrane. When the membranes treated by the process are utilised in carrier heads of this type the carrier heads typically demonstrate improved performance due to lower levels of membrane failure.

In another embodiment the present invention provides a carrier head for a chemical/mechanical polishing apparatus. The carrier head includes a base and a flexible membrane, the flexible membrane has a mounting surface for a substrate and extends beneath the base to define a boundary of a pressurizable chamber, the flexible membrane having been subjected to the process of the invention. The membrane preferably has a maximum tensile strength of at least 10.5 MPa, more preferably a tensile strength of at least 11.0 MPa. The membrane also preferably has an elongation at break of at least 820%, more preferably 850%. It is preferred that the flexible membrane has a central portion forming a mounting surface for a substrate and a peripheral portion that is preferably in contact with the base, the membrane extending beneath the base to define a chamber.

The carrier head preferably also includes a retaining ring which surrounds the central portion of the membrane. In a further preferred embodiment the retaining ring is connected to the base.

The carrier head also preferably further includes a support structure that is movable relative to the base, the support structure being located between the base and the flexible membrane. In a particularly preferred embodiment the peripheral portion of the flexible membrane is attached to the support structure, preferably extending around an edge of the support structure. In a further preferred embodiment the carrier head further includes a flexure connecting the support structure to the base. Preferably the flexure undergoes bending to allow the support structure and the flexible membrane to move away from the base as fluid is forced into the chamber.

In one preferred embodiment the support structure includes an annular ring and the membrane preferably extends around an outer rim of the annular ring. In this embodiment it is preferred that the chamber includes a first portion located above the annular ring and a second portion located below the annular ring.

In another preferred embodiment the support structure includes a circular plate. In this embodiment it is preferred that the chamber includes a first portion located above the annular ring and a second portion located below the annular ring.

In a preferred embodiment the support structure has at least one aperture therethrough to connect a first portion of the chamber between the flexible membrane and the support structure to a second portion of the chamber between the support structure and the base. In this embodiment the flexible membrane and support structure moves away from the base when fluid is forced into the chamber. It is preferred in this embodiment that the support structure contacts the surface of the flexible membrane. In a particularly preferred embodiment the support structure includes a plurality of apertures.

DETAILED DESCRIPTION OF THE INVENTION

Figure 1:
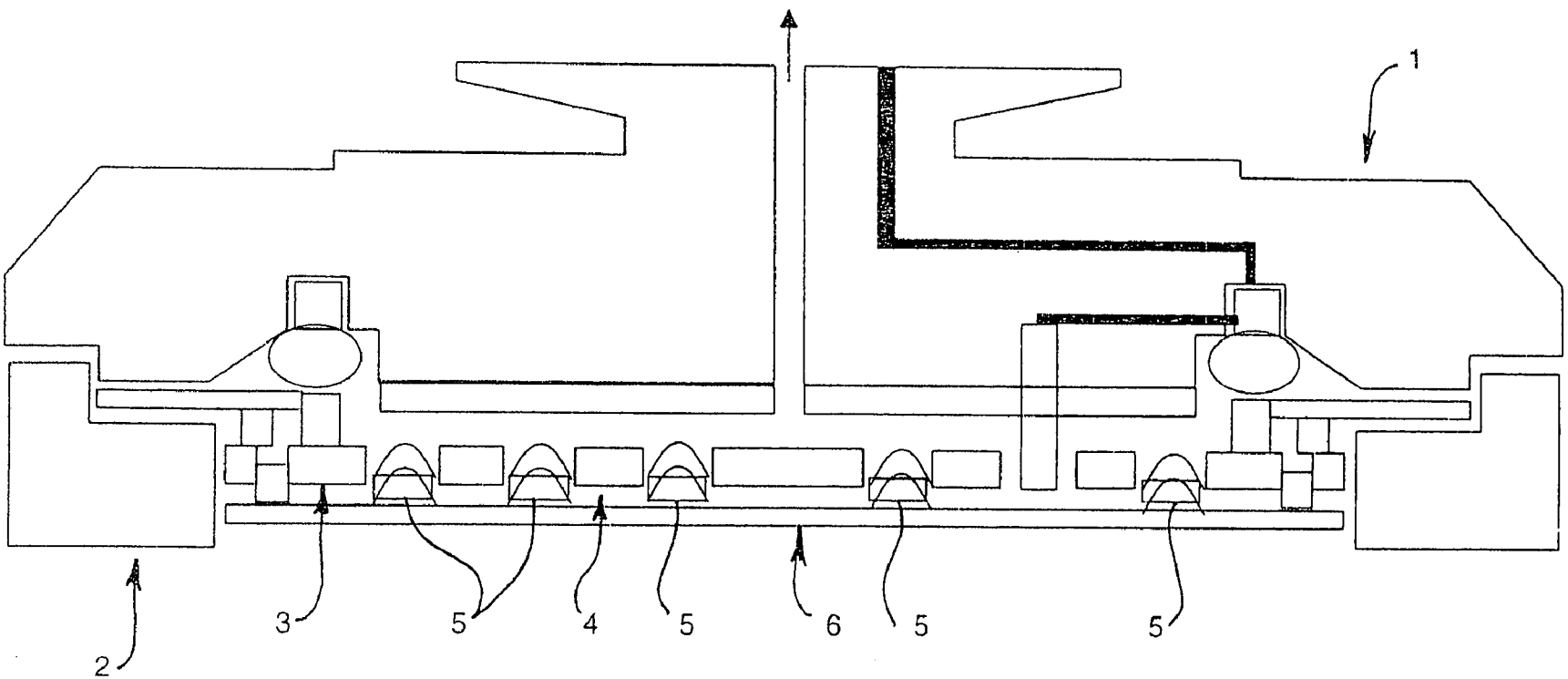
FIG. 1 This shows a sectional view of a carrier head incorporating a membrane.

The present invention provides improved membranes for use in chemical/mechanical polishing systems. In chemical mechanical polishing systems flexible membranes are used extensively and the way in which they are used is shown for example in FIG. 1. With reference to FIG. 1 there is shown a carrier head with an upper assembly (1) and a retaining ring (2). The carrier head includes a perforated support structure (3) which is located within the retaining ring (2). A flexible membrane (4) sits on the support structure and when a vacuum is applied the membrane (4) extends through apertures in the support structure (3) forming a plurality of suction cups (5). These suction cups hold onto wafer (6) such that it is held onto the carrier head by vacuum.

Figure 2:
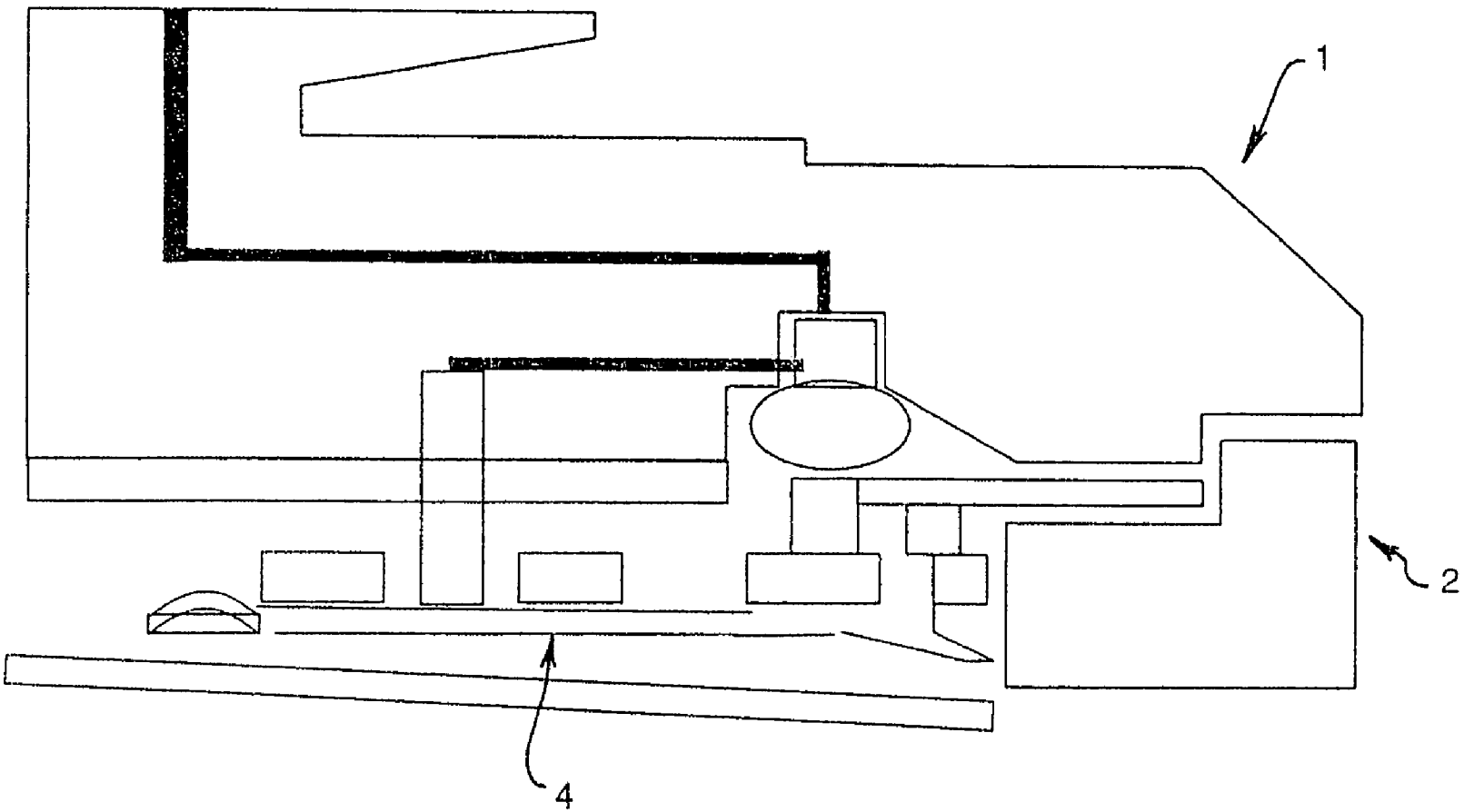
FIG. 2 This shows a sectional view of a portion of the carrier head of FIG. 1 following membrane failure.

The problem that occurs with membranes of this type is shown in FIG. 2 which depicts an exploded view of the carrier head of FIG. 1. If the membrane (4) fails the suction cups collapse and this releases the vacuum holding the wafer onto the membrane. When this occurs the wafer drops. There is therefore a need to develop improved membranes for use in CMP systems.

The applicants have found that the membranes to be subjected to the process of the invention can be manufactured de novo using well established membrane fabrication techniques. Accordingly the membranes to be subjected to the process may be purchased commercially. It has been found, however, that one of the simplest modifications of the known procedures is the incorporation of an additional treatment step into the production process for these membranes. This additional treatment step can be carried out at the end of the existing production process prior to the packaging of the known membranes, or alternatively, the existing packaged membranes may be subjected to the additional processing step at a later stage. For example the membranes may be subjected to the additional processing step just prior to use at the integrated circuit plant. One advantage of conducting the additional processing just prior to use is that it ensures no deterioration of the membrane properties before use.

The present invention therefore provides a method of improving the performance of a flexible membrane for use in a chemical/mechanical polishing system, the method including subjecting the membrane to elevated temperatures. It is preferred that following the treatment the membrane has a maximum tensile strength of at least 10 MPa and an elongation at break of at least 800%. It is further preferred that the membrane is treated until it has a maximum tensile strength of at least 10.5 MPa, more preferably at least 11.00 MPa. It is also preferred that the treatment is such that the membrane following treatment has an elongation at break of at least 820%, more preferably at least 850%.

The treatment period may be of any suitable time but is preferably no longer than 24 hours. The treatment period is typically from 5 minutes to 24 hours, more preferably from 5 minutes to 240 minutes, even more preferably from 10 minutes to 180 minutes, yet even more preferably from 20 minutes to 120 minutes, more preferably from 30 minutes to 90 minutes, most preferably from 60 to 90 minutes. The elevated temperature of the treatment is typically from 50° C. to 150° C., more preferably from 50° C. to 100° C., even more preferably from 60° C. to 95° C., most preferably from 75° C. to 90° C.

As will be readily appreciated there is a relationship between the duration of the treatment period and the temperature. Typically it is found that the higher the temperature the shorter time required. It is preferred that the treatment involves subjecting the membrane to a temperature of from 50° C. to 100° C. for a period of from 15 minutes to 120 minutes. It is even more preferred that the flexible membrane is subjected to a temperature of from 60° C. to 95° C. for a period of from 30 minutes to 90 minutes. In a most preferred embodiment the membrane is subjected to a temperature of from 75° C. to 90° C. for a period of from 30 minutes to 90 minutes, most preferably from 60 minutes to 90 minutes. A number of specific regimes within these ranges are particularly preferred. One preferred regime is 90° C. for 60 minutes. Another preferred regime is 80° C. for 60 minutes. A further preferred regime is 75° C. for 120 minutes.

The heat treatment discussed above may be carried out in any suitable heating apparatus which does not introduce contaminants onto the surface of the membrane. Examples of suitable heating apparatus include heating ovens and chambers. Due to the need to reduce contamination it is preferred that the heat source is such that external heating of the oven chamber is carried out so that no residue of the heating enters the chamber. As such heating devices such as ovens including a "naked" gas flame are typically not preferred.

The heating may occur in a continuous fashion in which membranes are passed through a heated oven or chamber with the speed of passage being such as to hold the membrane in the chamber or oven for the required residence time. Column heating devices suitable for heating in this way are well known in which the membrane travels the length of the column and is heated in the column. Due to the length of the heating required, however, it is typical to heat the membranes in a batchwise fashion in which one or more (typically a large number) of membranes are placed in an oven at the required temperature and left to heat for the required time.

After the membrane has been heated it is removed from the heat source and preferably placed at ambient temperature and allowed to cool. This preferably occurs in a clean room environment with a temperature of between 20° C. to 23° C. and a relative humidity of about 50%. Alternatively the membrane may be rapidly cooled by being placed in a cooled chamber or by having a cooled fluid or gas passed over the membrane.

After treatment the membranes preferably have a maximum tensile strength of at least 10.5 MPa, more preferably at least 11 MPa. As used herein the maximum tensile strength of a membrane is determined using ASTM D638: 2000. Using this standard test procedure the tensile strength of the treated membranes were determined using the following parameters:

| | |
|---|---|
| Type of test species | Dumb-bell Shape - Die C |
| Gauge Length | 25 mm |
| Length of Grips Separating | 64 mm |
| Gross head speed | 50 mm/min. |

When reference to maximum tensile strength is referred to in the specification or claims it is measured using this test.

The elongation at break of the membrane after treatment is preferably at least 820%, more preferably at least 850%.

The flexible membrane may be of any suitable size that enables it to be used in carrier heads for chemical/mechanical polishing. As will be understood by a skilled addressee membranes used in chemical/mechanical polishing systems will vary depending on the size of the integrated circuit being produced and the dimensions of the carrier head that the membrane is intended to be used on. It has been found, however, that the improvements in membranes identified by the applicant are applicable irrespective of the size of the membrane required and thus is applicable to all membranes for chemical/mechanical polishing systems.

In addition the membrane can be any suitable shape to fit the configuration of the carrier head and shape of the integrated circuit being produced. Nevertheless the membranes are typically substantially circular. Any suitable membrane thickness may suffice but it typically has a thickness of from 0.6 mm to 1.0 mm, most preferably a thickness of 0.8 mm.

The flexible membrane can be made of any suitable material typically used in membranes for chemical/mechanical polishing systems with the principle requirement that the membrane must be a flexible and elastic material. It is preferred that the membrane includes silicone rubber, preferably high strength silicone rubber.

The process may include a number of additional steps. For example the membrane may be washed prior to or after heating (or both) in order to remove any possible contaminants on the surface of the membrane. It is preferred that the membrane is washed with a solution to remove any organic contaminants on the surface. A suitable solution to achieve this is a solution of IPA (isopropyl alcohol) in water. The preferred concentration is 5% of IPA in water. It is also preferred that the membrane is washed with de-ionised water prior to treatment. It is found that such a washing step removes any residue left behind from other wash solutions (such as the IPA) and as well ensures that other particulate contaminants are removed.

The washing steps referred to above are carried out in ways well known in the art. It is preferred that the washing steps are carried out prior to treatment. If a washing step is included in the process the membrane is preferably dried prior to treatment. The drying may occur in any way know although it preferably involves air drying. Following completion of the treatment the membranes are stored prior to use.

The membranes that have been subjected to the process of the present invention may be used in any carrier head for a chemical/mechanical polishing system that incorporates at least one flexible membrane. Examples of preferred carrier head systems that may incorporate the flexible membranes treated by the process of the invention are those described in U.S. Pat. Nos. 6,080,050, 6,183,154, 6,540,594 and 6,506,104, the entire contents of which are herein incorporated by reference. As stated previously the use of the treated membranes significantly enhances carrier head life between failure.

In another embodiment the present invention therefore provides a carrier head for a chemical/mechanical polishing apparatus. The carrier head includes a base and a flexible membrane treated by the process of the invention, the flexible membrane has a mounting surface for a substrate and extends beneath the base to define a boundary of a pressurizable chamber. It is preferred that the flexible membrane has a central portion forming a mounting surface for a substrate and a peripheral portion that is preferably in contact with the base, the membrane extending beneath the base to define a chamber.

The carrier head preferably also includes a retaining ring which surrounds the central portion of the membrane. In a further preferred embodiment the retaining ring is connected to the base.

The retaining ring may be made of any suitable material. For example the retaining ring may preferably be made of a hard plastic or a similar material. The retaining ring may be secured to the carrier base in a number of ways well known in the art. It is preferred, however, that the retaining ring is secured to the carrier base by the use of bolts.

In general the retaining ring is secured at the outer edge of the carrier base. The retaining ring may be of any suitable shape and geometry for the carrier head used. Nevertheless the retaining ring is generally an annular ring with a substantially flat bottom surface.

In use, as the carrier head is lowered towards the polishing head of the chemical/mechanical polishing apparatus, a portion of the retaining ring contacts the polishing pads. Once this occurs an inner surface of the retaining ring in combination with a bottom surface of the flexible membrane defines a substrate receiving recess. When in use in the polishing apparatus the retaining ring acts to ensure that the substrate stays in the substrate receiving recess so that the substrate is not removed from the recess during the polishing process.

The carrier head also preferably further includes a support structure that is movable relative to the base located between the base and the flexible membrane. In a particularly preferred embodiment the peripheral portion of the flexible membrane is attached to the support structure, preferably extending around an edge of the support structure. In a further preferred embodiment the carrier head further includes a flexure connecting the support structure to the base.

The flexure used may be of any suitable type defined in the art. It is found, however, that the flexure is a generally planar annular ring which is typically flexible in the vertical direction and may be flexible or rigid in the other direction. Any suitable flexures used in the art may be incorporated. However it is preferred that the material used to manufacture the flexure is chosen so that the flexure has a durometer measurement between 30 on the Shore A scale and 70 on the Shore D scale. Examples of materials that may be used to meet these physical characteristics include rubber such as neoprene, elastomeric coated fabrics such as NYLON or NOMEX, plastics, or composite materials such as fibre glass. In general, the amount of flexibility of the flexure can vary however it is typically found that the flexure should be such that it allows the support structure to move by approximately 0.2–0.3 mm. In a typical embodiment of the invention the outer edge of the flexure is secured between a lower surface of the base and an upper surface of the retaining ring discussed previously.

Preferably the flexure undergoes bending to allow the support structure and the flexible membrane to move away from the base as fluid is forced into the chamber.

The support structure may be made of any suitable hard material. In one preferred embodiment the support structure includes a generally annular ring. In this embodiment it is preferred that the pressurizable chamber includes a first portion located above the annular ring and a second portion located below the annular ring. It is preferred in this embodiment that the membrane extends around an outer rim of the annular ring.

In another embodiment the support structure includes a circular plate. In general the plate has a generally planar lower surface and is suspended in the chamber defined by the membrane by the flexure as discussed previously. It is preferred that the plate is located in the chamber such that the chamber includes a first portion located above the circular plate and a second portion located below the circular plate. It is particularly preferred that the circular plate includes at least one aperture to connect the first portion of the chamber to the second portion of the chamber. In a most preferred embodiment the circular plate includes a plurality of chambers.

A carrier head of the invention which incorporates a flexible membrane typically operates in the following fashion. A substrate is loaded onto the substrate receiving surface of the membrane with the back side of the substrate in contact with the mounting surface of the membrane. The pressurizable chamber is then expanded by fluid such as air being pumped into the chamber or, alternatively, the fluid is pumped into a bladder that is in contact with the chamber thus causing the chamber to be pressurized. This in turn places downward pressure on the membrane which is forced against the edge of the substrate creating a fluid-tight seal between the substrate and the membrane. Once this has been achieved a pump is actuated to evacuate the chamber to create a low pressure pocket between the flexible membrane and the back side of the substrate thus chucking the substrate onto the membrane. As the substrate is then safely held onto the membrane the carrier head can then be actuated to move the membrane either to a transfer station or onto a polishing pad.

Of course, in embodiments where there are additional components in the carrier head these are involved in the process in ways well known in the art. As discussed previously there are a large number of other components that have been described for use in carrier heads, including flexible membranes which will not be discussed further.

The invention also relates to the use of the treated membranes of the invention as described above in a chemical/mechanical polishing system.

The present invention will now be described with reference to the following examples.

EXAMPLE 1

In order to demonstrate the process of the invention a number of silicone membranes were subjected to the process of the invention. The silicone membranes were sourced from Applied Materials under Part Number 0021-77650. A group of 18 silicone membranes were subjected to varying temperature/time regimes and a number of physical properties were then measured. The regimes were:

1. Control—no treatment.
2. 50° C. for 60 minutes.
3. 70° C. for 60 minutes.
4. 80° C. for 60 minutes.
5. 90° C. for 60 minutes.

In each case the silicone membrane was removed from the packaging, wiped with a solution of 5% IPA in water to remove surface organic compounds. The surface was then wiped with de-ionized water to clean off any remaining surface residue. The membrane is then dried and heated at the required temperature for 60 minutes. At the end of the treatment the membrane is removed from the heat source and left to cool in a clean room environment (Class 100-100,000, 20-20° C., 50% relative humidity) for 60 minutes. The membrane is then re-wrapped. The membrane thus obtained was tested for maximum tensile strength (MPa), Shore A hardness, elongation at break % and modulus of elasticity. The results are shown in the following table.

| | | Silicone Membranes | | | |
|---|---|---|---|---|---|
| Sample | S/No. | Shore A Hardness | Max. Tensile Strength (MPa) | Elongation at Break (%) | Modulus of Elasticity (MPa) |
| 1. Control | 1 | 75 | 9.1 | 717.5 | 1.5 |
| | 2 | 75 | 9.2 | 713.7 | 1.6 |
| 2. 50° C. | 1 | 76 | 10.2 | 831.9 | 1.5 |
| | 2 | 77 | 10.2 | 843.1 | 1.4 |
| | 3 | 77 | 10.4 | 839.1 | 1.9 |
| | 4 | 75 | 10.4 | 805.6 | 2.2 |
| 3. 70° C. | 1 | 77 | 11.0 | 824.5 | 1.9 |
| | 2 | 77 | 10.7 | 809.2 | 1.7 |
| | 3 | 78 | 11.3 | 890.9 | 1.6 |
| | 4 | 79 | 10.6 | 760.2 | 3.0 |
| 4. 80° C. | 1 | 75 | 11.1 | 860.3 | 1.1 |
| | 2 | 74 | 11.2 | 827.4 | 2.1 |
| | 3 | 75 | 10.4 | 807.3 | 1.8 |
| | 4 | 74 | 10.5 | 817.5 | 2.0 |

-continued

| Sample | S/No. | Silicone Membranes | | | |
|---|---|---|---|---|---|
| | | Shore A Hardness | Max. Tensile Strength (MPa) | Elongation at Break (%) | Modulus of Elasticity (MPa) |
| 5. 90° C. | 1 | 76 | 10.5 | 863.6 | 1.5 |
| | 2 | 77 | 9.4 | 805.7 | 1.7 |
| | 3 | 74 | 10.1 | 867.5 | 1.2 |
| | 4 | 76 | 10.7 | 852.6 | 1.8 |

As can be seen the prior art membranes with the unacceptable performance characteristics typically have a maximum tensile strength of less than 10 MPa on an elongation at break of the order of about 700%. As discussed previously membrane failure when membranes of this type are used is of the order of 3.5 wafer drops (membrane failures) per 10,000 wafer moves. In effect, this equals the membrane failing after it has been activated on average 3,000 times.

The treated membranes that have been subjected to the process of the invention, in contrast, typically have a maximum tensile strength of at least 10 MPa and an elongation at break of in excess of 800%. Whilst this change may seem small following the use of the treated membranes the membrane failure rate drops to as low as 1 wafer drop (membrane failure) per 10,000 wafer moves. This equates to the membrane being activated more than 10,000 times on average before it fails. This change therefore more than triples the effective membrane life.

EXAMPLE 2

A number of silicon membranes were prepared according to the general method outlined in Example 1. These were then subjected to a wafer grip test.

This typically involves placing a membrane on the carrier head and inverting it on a test surface. A transport cover is slid over the head and the wafer grip test function is activated. The retaining ring is then pressurized and presses against the cover. This is followed by the membrane being pushed against the cover by pressure until it presses flat on the cover to make full contact. The membrane is then subjected to vacuum which creates small suction cups with the help of a perforated backing plate which grips the cover. In order to rate a pass the membrane must stick to the cover for at least 1 minute. If the membrane fails it collapses immediately when the vacuum is applied.

For each membrane the grip test was performed 10 times. The applicants have found that the results of the grip test correlate to membrane performance.

| Process Variables | | |
|---|---|---|
| Temperature | Time of Exposure | Grip Test Pass |
| 50° C. | 120 m | 90 |
| 50° C. | 60 m | 80 |
| 75° C. | 60 m | 95 |
| 75° C. | 120 m | 100 |
| 80° C. | 60 m | 100 |
| 90° C. | 60 m | 100 |
| 100° C. | 30 m | 100 |

As can be seen treating the membranes at temperatures of from 75° C. to 100° C. gave the best grip test possible. With reference to the 75° C. treatment it can be seen that with lower temperatures an extended treatment time of 120 minutes rather than 60 minutes improves wafer performance from 95% to 100%.

EXAMPLE 3

Figure 3:
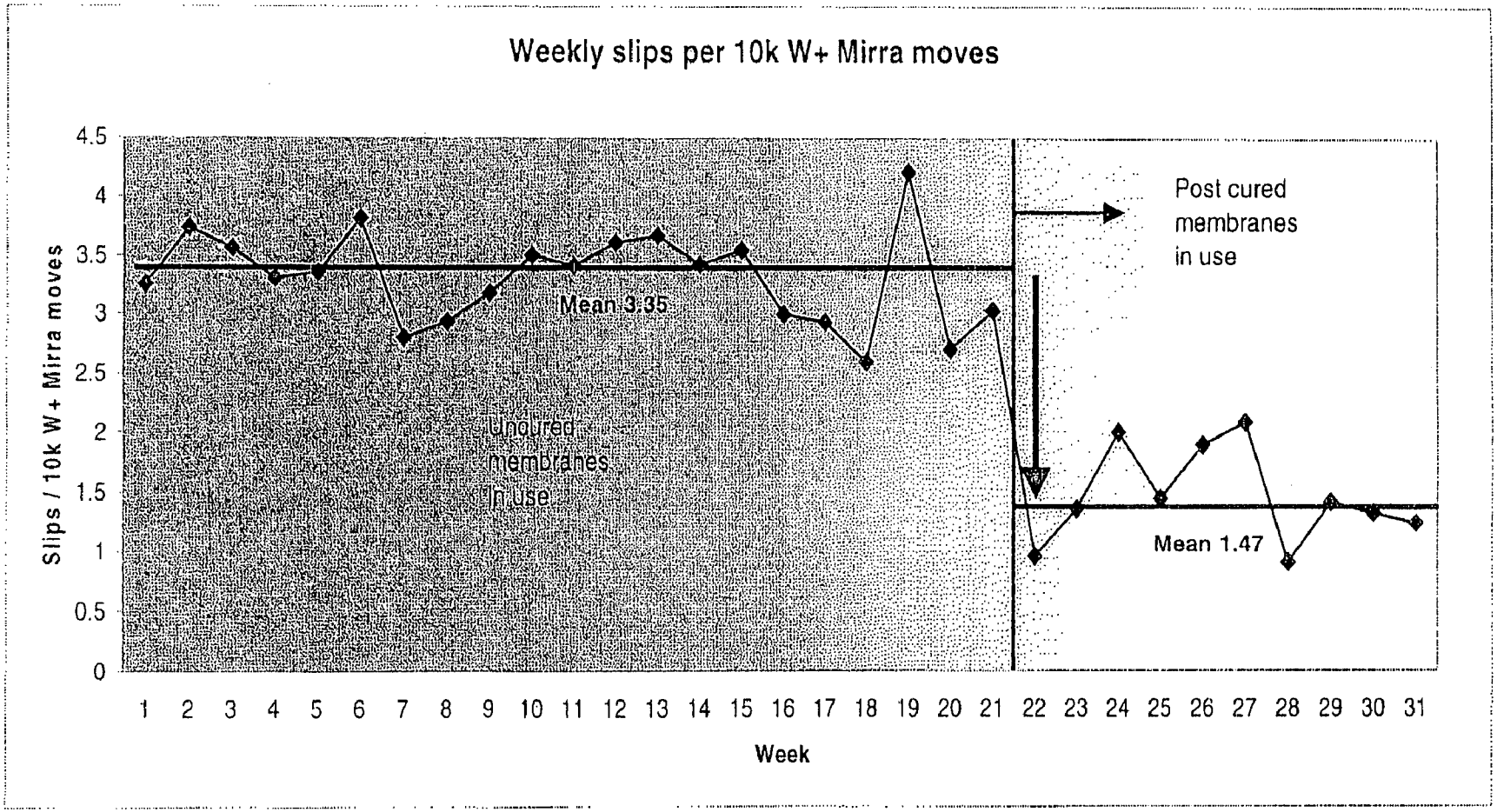
FIG. 3 This shows a graph demonstrating the results of an extended trial in which a pilot plant was operated with commercially available membranes followed by replacement of these membranes with membranes treated by the process of the invention.

As a result of the improvements demonstrated by the membranes treated by the process of the invention it was decided to take a batch membranes that had been subjected to the process of the invention. These were then trialled in a pilot scale laboratory under full factory operating condition. This was to enable to full number of wafer movements to be carried out to ensure that the date obtained was statistically significant. The results are shown as FIG. 3. As can be seen in FIG. 3 the prior art membrane had a rate of membrane failure such that there were 3.35 wafer slips per 10,000 membrane movements. Following replacement of the prior art membrane with membranes that had been treated thus reduced to 1.47 wafer slips per 10,000 movements. This demonstrates the efficacy of the process of the invention in improving flexible membrane performance.

The invention claimed is:

1. A method of improving the properties of a flexible membrane for use in chemical/mechanical polishing, the method including subjecting the membrane to elevated temperatures of from 50° C. to 150° C.

2. A method according to claim 1, wherein the membrane is subjected to a temperature of from 50 to 100° C.

3. A method according to claim 1, wherein the membrane is subjected to a temperature of from 60° C. to 95° C.

4. A method according to claim 1, wherein the membrane is subjected to a temperature of from 70° C. to 90° C.

5. A method according to claim 1, wherein the membrane is subjected to elevated temperatures for a period of from 5 to 240 minutes.

6. A method according to claim 1, wherein the membrane is subjected to elevated temperatures for a period of from 20 minutes to 120 minutes.

7. A method according to claim 1, wherein the membrane is subjected to elevated temperatures for a period of from 30 minutes to 90 minutes.

8. A method according to claim 1, wherein the membrane is treated at a temperature of about 70° C. for about 60 minutes.

9. A method according to claim 1, wherein the membrane is treated at a temperature of about 80° C. for about 60 minutes.

10. A method according to claim 1, wherein the membrane is treated at a temperature of about 90° C. for about 60 minutes.

11. A method according to claim 1 wherein the membrane includes silicone rubber.

12. A method according to claim 1 wherein following treatment the membrane has a tensile strength of at least 10.5 MPa.

13. A method according to claim 1, wherein the membrane is subjected to elevated temperatures of from 75° C. to 90° C. for a period of from 60 minutes to 90 minutes.

* * * * *

UNITED STATES PATENT AND TRADEMARK OFFICE

CERTIFICATE OF CORRECTION

PATENT NO. : 7,201,642 B2
APPLICATION NO. : 10/544010
DATED : April 10, 2007
INVENTOR(S) : Meng Fei Koh et al.

It is certified that error appears in the above-identified patent and that said Letters Patent is hereby corrected as shown below:

On title page
Item [22] delete "Jun. 14, 2004" and insert threrefore --June 17, 2004--.

Signed and Sealed this

Thirty-first Day of July, 2007

JON W. DUDAS
*Director of the United States Patent and Trademark Office*